US010738427B1

(12) United States Patent
Raihala

(10) Patent No.: US 10,738,427 B1
(45) Date of Patent: Aug. 11, 2020

(54) CANE OR WALKING STICK RETRIEVING TIP

(71) Applicant: Kenneth Herman Raihala, Superior, WI (US)

(72) Inventor: Kenneth Herman Raihala, Superior, WI (US)

( * ) Notice: Subject to any disclaimer, the term of this patent is extended or adjusted under 35 U.S.C. 154(b) by 0 days.

(21) Appl. No.: 16/501,992

(22) Filed: Jul. 19, 2019

(51) Int. Cl.
*E01H 1/12* (2006.01)
*A45B 9/04* (2006.01)

(52) U.S. Cl.
CPC ..... *E01H 1/12* (2013.01); *A45B 9/04* (2013.01); *E01H 2001/1293* (2013.01)

(58) Field of Classification Search
CPC ..... A45B 9/04; A45B 3/00; E01H 2001/1293
USPC ..... 135/66
See application file for complete search history.

(56) References Cited

U.S. PATENT DOCUMENTS

| | | | | |
|---|---|---|---|---|
| 4,098,283 | A * | 7/1978 | Tritle, Jr. | A45B 9/04 135/77 |
| 4,135,536 | A * | 1/1979 | Willis | A45B 9/04 135/78 |
| 4,200,322 | A | 4/1980 | Smith | |
| 4,811,750 | A * | 3/1989 | McAllister | A45B 3/00 135/66 |
| 4,938,516 | A * | 7/1990 | Temple | E01H 1/12 294/104 |
| 5,176,160 | A | 1/1993 | Osborn | |
| 5,192,104 | A | 3/1993 | Lin | |
| 5,392,800 | A | 2/1995 | Sergi | |
| 5,636,650 | A | 6/1997 | Kroeze | |
| 5,640,985 | A | 6/1997 | Snyder et al. | |
| 6,058,953 | A | 5/2000 | Stefanelli | |
| 6,527,321 | B1 | 3/2003 | Kuciauskas | |
| 7,243,668 | B1 * | 7/2007 | Kroeze | A45B 3/00 135/66 |
| 8,714,173 | B2 | 5/2014 | Rosen | |
| 9,277,794 | B2 * | 3/2016 | Moreau | A45B 9/00 |
| 9,386,831 | B1 * | 7/2016 | Raihala | A61H 3/0288 |
| 2009/0159107 | A1 | 6/2009 | Davenport | |
| 2009/0288693 | A1 | 11/2009 | Lasota | |
| 2014/0360544 | A1 * | 12/2014 | Raihala | A45B 9/04 135/66 |

FOREIGN PATENT DOCUMENTS

| | | | |
|---|---|---|---|
| WO | WO2008/094103 A1 | 8/2008 | |
| WO | WO-2008094103 A1 * | 8/2008 | A45B 9/04 |

* cited by examiner

*Primary Examiner* — Joshua T Kennedy

(57) ABSTRACT

A retrieving tip for a cane or walking stick that provides the user a means to retrieve objects from a walking surface. The device employs a single moveable finger contained within the tip that can be extended for use with the user's foot. The finger when extended may be guided by the user to slip beneath an object to be retrieved and secured between the finger and tip body when the cane or walking stick is pushed downward against the walking surface. The tip may be furnished on new canes and walking sticks or as a replacement tip on existing canes or walking sticks. No maintenance or adjustments are required.

1 Claim, 1 Drawing Sheet

SECTION A-A

SECTION B-B

CANE OR WALKING STICK RETRIEVING TIP

FIELD OF THE INVENTION

This patent application applies to the field of retrieving canes and walking sticks.

BACKGROUND ART

The use of canes and walking sticks by the elderly or others afflicted by illness or injury is well known. The U.S. patents searched by this applicant have shown that innovators and inventors have focused on devices for canes and walking sticks to help the user overcome various challenges. One of those challenges relates to retrieving accidentally dropped objects when the user may be in a public place. It is recognized that most cane users do not have the flexibility to bend over to retrieve objects from a walking surface without losing their balance and falling. A number of patents searched by this applicant have disclosed attempts to solve this problem by use of various devices attached to the exterior or within the hollow shafts of canes or walking sticks. These devices are operated by the user to retrieve an object from a walking surface without assistance from others. The patents searched have disclosed that most of the devices searched were designed to retrieve objects having vertical height, using a pinching type action above the object. This pinching action is not suitable for accidentally dropped objects such as credit cards, currency and other thin objects not having vertical height. The devices searched may require frequent maintenance of components, lubrication or mechanical adjustments and a good amount of labor and expense to assemble.

DRAWING—REFERENCE NUMBERS (CLEAN COPY)

10. Body
12. Hole
14. Socket
16. Disk
18. Knob
18*a* Bore
18*b* Hole
20. Finger
22. Tread
24. Recess
26. Finger Recess

DETAILED DESCRIPTION—FIRST EMBODIMENT

Referring to FIG. 1 depicts an assembled cane or walking stick retrieving tip shown in vertical orientation, configured to fit onto the lower end of a cane or walking stick shaft. The retrieving tip is comprised of a Body 10, Finger 20 and Knob 18. The Body 10 is formed by molding or fabrication, of an elastomeric or rubber material or of other methods or materials as known by those skilled in the arts. Body 10 is in a generally elongated conical shape having an upper section and a generally larger lower section with one elongated side. The body 10 side walls slope from the upper section to the generally larger lower section. The upper section of Body 10 contains a Socket 14 access opening terminating in the lower section of Body 10 and aligned with the generally conical axis to receive the lower end of a cane or walking stick shaft for a frictional engagement. The Socket 14 may be formed by molding, drilling or by other means known by those in the art. A Disk 16 made of metal, plastic or a material known by those in the art to be capable of preventing cut-through by hollow shaft metal canes, may be placed into the mold prior to the molding process or placed into the bottom of Socket 14 after the molding process is complete. Body 10 includes a Hole 12 entering the upper section of Body 10 and exiting in the Finger Recess 26 of the lower section. The axis of Hole 12 is parallel with the axis of Socket 16 at a predetermined distance. Hole 12 may be formed in the molding process, drilled, broached or as known to those skilled in the art. Hole 12 is of a predetermined size and shape to accept a Finger 20 of the same predetermined size and shape for slidable communication with Hole 12. The lower section of Body 10 comprises a plurality of Recess 24 and Ridge 22 in a predetermined arrangement to provide a contact surface to prevent slipping of the tip on wet or slippery surfaces. A Finger Recess 26 is formed in the lower section of the Body 10, aligned with the lateral direction of the Body 10 lower section. Finger Recess 26 is of a predetermined width and depth and extends from the axis of Hole 12 a predetermined distance within the perimeter of the Body 10. The finger recess extends in an opposite direction from the axis of Hole 12 along the lateral direction through the perimeter of the body. Finger Recess 26 (as depicted in FIG. 6) can be seen to be of greater depth than Recess 24 of Body 10. Finger 20 (depicted in FIG. 3) comprises an upper section and a lower section with the upper section intersecting the lower section perpendicularly in a tee shape. Finger 20 may be formed by casting, welding or fabrication of a metal, plastic or of a material known to those in the art. Finger 20 upper section may be of a predetermined size and shape to engage slidably with a specific predetermined size and shape of Hole 12. However, Hole 12 may be of a different cross sectional shape than the cross sectional shape of the upper section of the Finger 20 to increase friction as deemed necessary by the craftsperson for a slidable engagement. The upper section cross sectional shape of Finger 20 is of a predetermined length, to be determined by the craftsperson for a range of object sizes to be retrieved. The end of the upper section of the Finger 20 may be threaded, or otherwise prepared for attachment to Knob 18 by means as known to those in the art. The end of the Finger lower section consists of a horizontal section preferably of the same size and shape of the material of the upper section. The preferred material would be brass in a square shape. The intersection of the upper section of Finger 20 with the lower section creates a horizontal section having a first end and an opposite end. The first end of the horizontal section is provided with a ramp of predetermined length. The horizontal section has an upper surface and a lower surface. The ramp slopes from the upper surface of the horizontal section to the lower surface of the horizontal section, creating a sharp point at the first end. The intersection of the upper section of Finger 20 with the lower section also creates an extension of the horizontal section in an opposite direction along the lateral direction of the lower section of the Body 10, extending from the axis of Hole 12 to a predetermined distance through the perimeter of the lower surface of the Body 10. This extension provides a means of preparing the tip for retrieving an object by use of a foot. Knob 18 is in a generally elongated cylindrical shape having an upper surface and a lower surface. The side walls of Knob 18 extend from the upper surface to the lower surface. Knob 18 may be formed of plastic, metal or of other materials as known by those in the art by molding or fabrication. The upper surface of Knob 18 contains a Bore 18*a* having an access opening extending through the lower surface aligned with the generally cylindrical axis. Bore 18*a* may be formed by a molding process, drilled or by other methods known by those in the art and of size to accept the lower portion of a cane or walking stick slidably. Hole 18*b* may be formed in the molding process or by drilling, entering the lower surface of surface of Knob 18 and aligned with the generally cylindrical axis a predetermined distance to create a blind hole. The distance between Hole 18*b* and Bore 18*a* of Knob 18 must be identical to the distance between Hole 12 and Socket 14 of Body 10. The preferred means of attachment to Finger 20 is by adhesive, although interference fit or use of a set screw, pinning or by other means known to those in the art may be used.

Assembly of Retrieving Tip

The receiving tip is assembled by inserting the end of the upper section of the finger into the hole located in the finger recess of the tip body, entering from the lower section of the body and exiting the upper section of the body. The lower section of the finger horizontal section extension must be aligned within the finger recess located in the lower section of the body having the ramped end of the lower section of the finger lying within the perimeter of the body lower section. The opposite end of the lower section of the finger extends a predetermined distance through the perimeter of the tip body. A knob is placed onto the upper end of the finger having with its Bore in axial alignment with the socket axis of the body. The lower end of the cane or walking stick shaft is inserted through the bore of the knob and into the socket of the body for a frictional engagement with the socket and for a slidable engagement with the knob. Keeping the lower section of the finger centered within the finger recess, the knob may then be secured with an adhesive known to those in the art. Other means of attachment of the knob to the upper section of the finger may be used to allow for replacement of worn or damaged components. The retrieving tip may be rotated on the lower end of a cane or walking stick shaft to a position required by the user to provide a convenient foot access to the lower section of the finger extending through the perimeter of the tip body.

Operation of Retrieving Tip

The retrieving tip under normal walking conditions must have the lower section of the finger stored deep within the provided finger recess. This is to prevent accidental contact of the lower section of the finger with the walking surface when walking that may result in tripping or a possible fall. To prepare the tip for retrieving an object from a walking surface, the user places the tip in contact with the walking surface in a generally vertical orientation. The user then places a foot onto the lower portion of the finger horizontal section extending through the perimeter of the lower section of the body and raises the cane or walking stick shaft vertically, or in a direction to move the contact surface of the tip body away from the walking surface while continuing to hold the finger horizontal section in contact with the walking surface. This action results in an extension of the finger horizontal section below the body contact surface, limited only by the predetermined length of the upper section of the finger and contact of the lower surface of the knob with the upper section of the body. With the horizontal section of the finger extended, the user guides the ramped end of the lower section of the finger beneath the object to be retrieved. If the object is light and tends to move away from the ramped end of the horizontal section, the user may place a foot on or alongside the object to prevent movement. The user then pushes downward on the cane or walking stick handle (or in a direction to move the lower section of the finger towards the retrieving tip contact surface) to result in a clamping action securing the object. The user raises the cane or walking stick to retrieve the object in hand by pulling the object from the retrieving tip or releasing the object by pushing the knob in a direction to release the object. Prior to returning the cane or walking stick to a normal walking position, the user may return the finger lower section into the finger recess provided by sliding the knob in a direction to return the finger lower section deep into the finger recess.

DRAWING—FIGURES

DRAWING—REFERENCE NUMBERS

Figure 1:
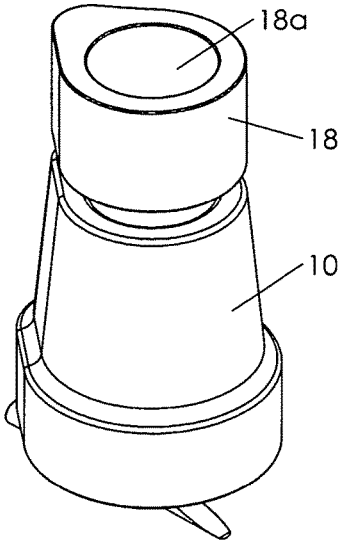
FIG. 1 is an isometric view of an assembled retrieving tip for a cane or walking stick tip shown in vertical orientation.
Figure 2:
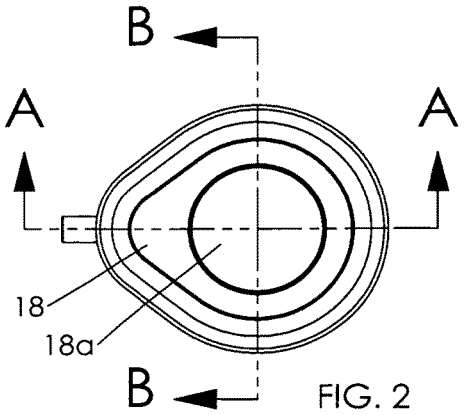
FIG. 2 is a top view of an assembled retrieving tip for a cane or walking stick.
Figure 3:
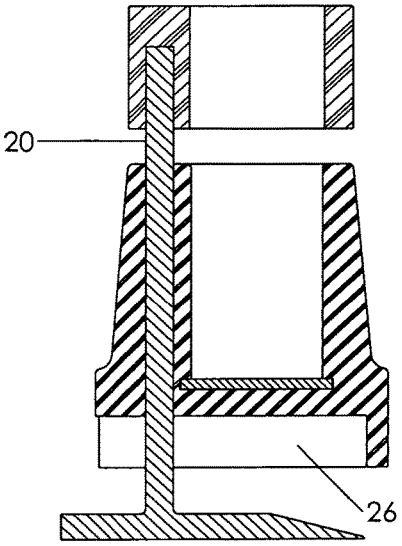
FIG. 3 is a cross-sectional elevation view of a retrieving tip for a cane or walking stick along Section A-A.
Figure 5:
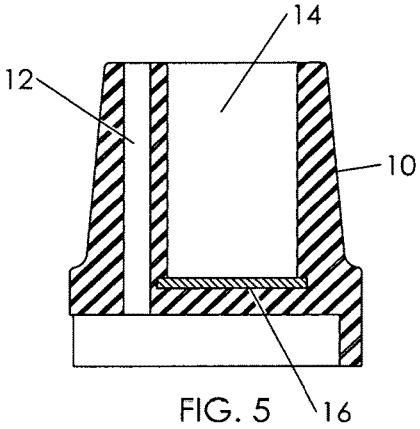
FIG. 5 is a cross-sectional elevation view of a retrieving tip body for a cane or walking stick tip.
Figure 6:
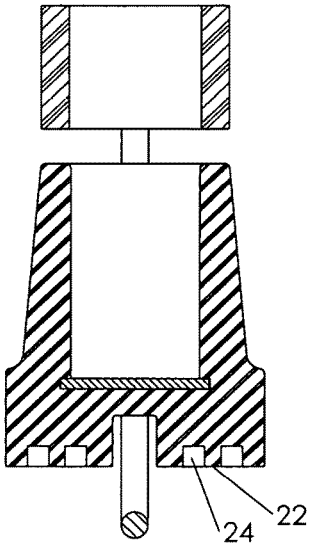
FIG. 6 is a cross-sectional elevation view of an assembled retrieving tip for a cane or walking stick along Section B-B.
Figure 7:
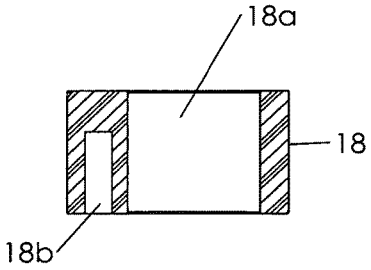
FIG. 7 is a cross-sectional elevation view of a knob for a cane or walking stick retrieving tip along Section A-A.
Figure 4:
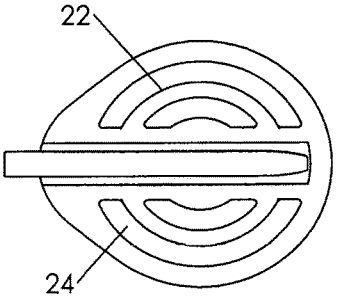
FIG. 4 is a bottom view of a retrieving tip for a cane or walking stick.

10. Body
12. Hole
14. Socket
16. Disk
18. Knob
18*a* Bore
18*b* Hole
20. Finger
22. Tread
24. Recess
26. Finger Recess

What is claimed is:

1. A retrieving tip for a cane, crutch or a walking stick, comprising:

a body, a finger and a knob;

the body comprising:

a socket configured to accept a cane, crutch or walking stick;

a hole sized and shaped to slidably receive a vertical section of the finger;

a contacting surface; and a finger recess within the contacting surface, the finger recess extending in a first lateral direction from an axis of the hole in the body to a first end within a perimeter of the body and in an opposite direction through the perimeter of the body;

the finger further comprising a horizontal section at a lower end of the vertical section of the finger, the horizontal section receivable in the finger recess in a retracted position such that a first end of the horizontal section extends to said first end of said finger recess and a second end of the horizontal section extends beyond the perimeter of the body; and a knob at an upper end of the vertical section of the finger, wherein the finger can be moved out of the recess by lowering the knob with respect to the body and retracted into the recess by raising the knob with respect to the body.

* * * * *